US008783937B2

(12) United States Patent
Steedly

(10) Patent No.: US 8,783,937 B2
(45) Date of Patent: Jul. 22, 2014

(54) LED ILLUMINATION DEVICE WITH ISOLATED DRIVING CIRCUITRY

(75) Inventor: James Steedly, Menifee, CA (US)

(73) Assignee: Maxlite, Inc., West Caldwell, NJ (US)

( * ) Notice: Subject to any disclaimer, the term of this patent is extended or adjusted under 35 U.S.C. 154(b) by 76 days.

(21) Appl. No.: 13/570,473

(22) Filed: Aug. 9, 2012

(65) Prior Publication Data

US 2013/0044478 A1 Feb. 21, 2013

Related U.S. Application Data

(60) Provisional application No. 61/523,695, filed on Aug. 15, 2011.

(51) Int. Cl.
*F21V 29/00* (2006.01)
*F21V 7/00* (2006.01)

(52) U.S. Cl.
USPC ..... 362/646; 362/249.02; 362/373; 362/640

(58) Field of Classification Search
USPC ..... 362/294, 373, 249.02, 800, 616, 646
See application file for complete search history.

(56) References Cited

U.S. PATENT DOCUMENTS

| | | | | |
|---|---|---|---|---|
| 6,787,999 | B2 | 9/2004 | Stimac et al. | |
| D497,439 | S | 10/2004 | Shaw et al. | |
| 6,874,911 | B2 | 4/2005 | Yoneda | |
| 7,175,306 | B2 | 2/2007 | Pan | |
| D539,935 | S | 4/2007 | Mama | |
| D566,323 | S | 4/2008 | Piepgras et al. | |
| 7,458,706 | B1 | 12/2008 | Liu et al. | |
| 7,482,632 | B2 | 1/2009 | Lu et al. | |
| 7,607,802 | B2 | 10/2009 | Kang et al. | |
| 7,663,229 | B2 | 2/2010 | Lu et al. | |
| 7,690,801 | B2 | 4/2010 | Amphlett | |
| 7,701,055 | B2 | 4/2010 | Wu et al. | |
| 7,703,951 | B2 | 4/2010 | Piepgras et al. | |
| 7,766,518 | B2 | 8/2010 | Piepgras et al. | |
| 7,837,362 | B2 | 11/2010 | Zhang | |
| 7,866,850 | B2 | 1/2011 | Alexander et al. | |
| 7,871,184 | B2 * | 1/2011 | Peng | 362/294 |
| 7,874,702 | B2 | 1/2011 | Shuai et al. | |
| 8,042,969 | B2 * | 10/2011 | Paik et al. | 362/241 |
| 8,585,242 | B2 * | 11/2013 | Walczak et al. | 362/249.02 |
| 2006/0061997 | A1 | 3/2006 | Lin | |
| 2009/0103296 | A1 | 4/2009 | Harbers et al. | |
| 2009/0109689 | A1 | 4/2009 | Boyer | |
| 2010/0195333 | A1 | 8/2010 | Schaefer et al. | |
| 2010/0226139 | A1 | 9/2010 | Lynch et al. | |

OTHER PUBLICATIONS

Transcend—Solid State Lighting, Puck Style LED available at www.molex.com. May 22, 2009.

* cited by examiner

*Primary Examiner* — Anabel Ton
(74) *Attorney, Agent, or Firm* — Vedder Price P.C.

(57) ABSTRACT

The present disclosure generally relates to several embodiments of a new illumination device using a plurality of LEDs, the device is designed to better diffuse heat produced from a heating driver circuitry and the LEDs in a way that allows for either the operating or equilibrium temperatures of the heat sensitive elements as part of the device to be subject to less stringent temperature increases and therefore improve the viability and energy performance of the device. The new design includes toroid-shaped external rings for the plurality of LEDs and a middle opening for the driver circuitry. The new design further includes fins and the use of different spaces and openings within the housing to help control the flow of heat by way of thermal conduction, thermal convection, or thermal irradiation.

18 Claims, 10 Drawing Sheets

2200

LED ILLUMINATION DEVICE WITH ISOLATED DRIVING CIRCUITRY

CROSS-REFERENCE TO RELATED APPLICATIONS

This application claims the benefit of U.S. Provisional Application No. 61/523,695, filed Aug. 15, 2011.

FIELD OF THE INVENTION

The present disclosure generally relates to an illumination device and, more particularly, to a light emitting diode ("LED")-based illumination device with improved heat evacuation properties

BACKGROUND OF THE INVENTION

Most lighting applications utilize incandescent or gas-filled bulbs, particularly lighting applications that require more than a low level of illumination. Incandescent bulbs typically do not have long operating lifetimes and thus require frequent replacement. Gas-filled tubes, such as fluorescent or neon tubes, may have longer lifetimes, but operating using dangerously high voltages, are relatively expensive and include hazardous materials such as mercury. Further, both bulbs and gas-filled tubes consume substantial amounts of power.

In contrast, LEDs are relatively inexpensive, operate at low voltage, and have long operating lifetimes. Additionally, LEDs consume relatively little power, are compact, and do not include toxic substances. These attributes make LEDs particularly desirable and well suited for many applications.

What is desired are LEDs that produce the greatest amount of light for a fixed rate of energy. The overall efficiency of LEDs is reduced when energy is transformed in heat rather than into light. Although it is known that the brightness of the light emitted by an LED can be increased by increasing the electrical current supplied to the LED, increased current also increases the junction temperature of the LED where the anode and cathode is attached below the semi-transparent (and often colored) epoxy resin tip. Increasing the steady state temperature of the junction of an LED in turn reduces the efficiency and lifetime of the LED as the heated structure's resistivity is increased. Advances in LED technology have brought increasingly bright LEDs. However, such increased brightness is accompanied by increased heat generation, lower lifetime of the structure generally resulting in a greater need to evacuate heat produced by the LED and other heat generating components to reduce its temperature and in turn increase life expectancy and reduce power consumption.

Consequently, there exist a need for a solution that helps dissipate and otherwise transferring heat generated by the LEDs and their associated circuitry away from the LEDs themselves to increase the efficiency and lifetime of such products. In addition to optimizing the thermal properties of such an LED lamp or illumination device, there is a need to reduce material costs and to incorporate the foregoing in a lamp or illumination device in a form factor that is similar to that of the PAR style and the GU24 Circline lamps.

SUMMARY

The present disclosure generally relates to several embodiments of a new illumination device using a plurality of LEDs, the illumination device is designed to better diffuse heat produced from a heating driver circuitry and the LEDs in a way that allows for either the operating or equilibrium temperatures of the heat sensitive elements as part of the device to be subject to less stringent temperature increases and therefore improve the viability and energy performance of the device. The new design includes toroid-shaped external rings for the plurality of LEDs and a middle opening for the driver circuitry. The new design further includes fins and the use of different spaces and openings within the housing to help control the flow of heat by way of thermal conduction, thermal convection, or thermal irradiation.

BRIEF DESCRIPTION OF THE DRAWINGS

The invention will be more readily understood in view of the following description when accompanied by the below figures and wherein like reference numerals represent like elements.

DETAILED DESCRIPTION

Figure 1:
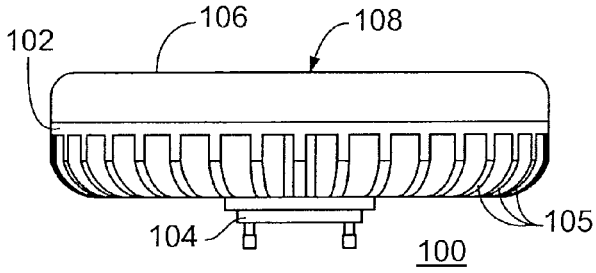
FIG. 1 illustrates a side view of an LED illumination device in accordance with a first embodiment of the disclosure.

In the following detailed description, numerous specific details are set forth in order to provide a thorough understanding the present disclosure. It will be apparent to one of ordinary skill in the art, however, that these specific details need not be used to practice the present disclosure. In other instances, well-known structures, interfaces and processes have not been shown or de FIG. 1 illustrates a side view 100 of an LED illumination device in accordance with a first embodiment of the disclosure. LED illumination device comprises housing 102 having a plurality of heat transfer fins 105, base plug 104, diffuser 106 and cap 108. In one embodiment, housing 102 comprises aluminum alloy 5052. In another embodiment, housing 102 comprises die cast aluminum. Those of skill in the art, however, will appreciate that any other form of metal or metal allow may be substituted for aluminum and/or aluminum alloy 5052 Those of skill in the art will further appreciate that different environments of use will dictate the type of metal or metal alloy used. To help evacuate heat, metal or metal allow is a good conductor and if given the right surface finish will have the required roughness to increase surface natural convection in the air. In one embodiment, as shown, housing 102 is generally circular in nature. It is recognized, however, that housing 102 may take any desired shape such as but not limited to that of a square, oval, rectangle, etc. In the embodiment as shown, the circular housing allows for the LED illumination device 100 to have the same natural air convection coefficient whatever the radial orientation at installation (i.e. offer a 360 deg. symmetry in cooling).

Figure 3:
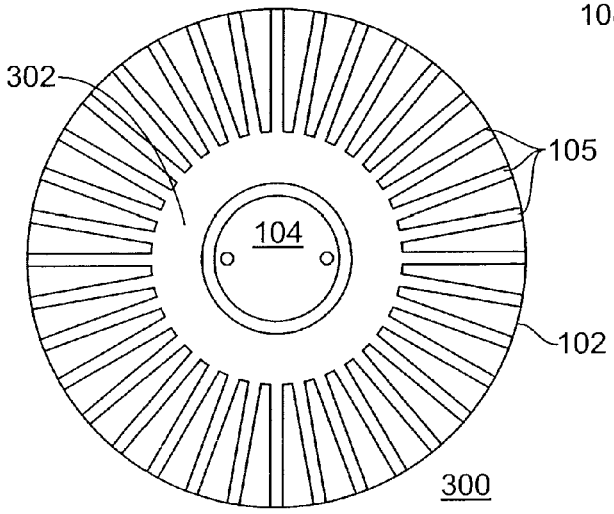
FIG. 3 illustrates a bottom view of the LED illumination device of FIG. 1.

As illustrated, the exterior sides and base of housing 102 comprise a plurality of fins 105 that protrude radially outward from the center of the base of the housing 102 (as seen in FIG. 3). The plurality of fins 105 assist housing 102 in the thermal transfer of heat from the heat-generating sources associated with the LED illumination device 100 (e.g., the LEDs themselves and driving/power supply circuitry, not shown in this FIG.) to the atmosphere via convection and/or irradiation. The fins 105 increase the contact surface area between the heated housing and the cooler atmospheric or ambient air and create passages for the flow of heating air moving under its own convective force. As shown, the fins 105 are placed both at the circumference of the housing 102 and as part of the radial base between the base plug 104 and the outside periphery of the housing 102. These fins 105 allow for the flow of convective air if the housing is horizontal, vertical, or in any intermediate orientation.

Figure 7:
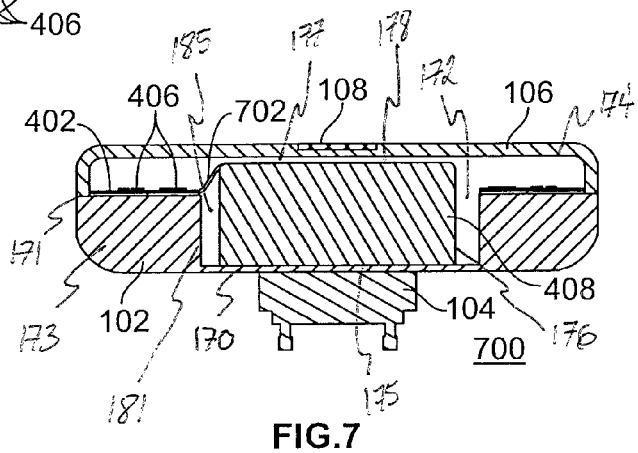
FIG. 7 illustrates a cross-sectional view of the LED illumination device of FIG. 1.

Base plug 104 is coupled to the base of the housing 102 using an appropriate fastener as is known in the art on a bottom surface 182 of the housing plate 170. In one example, base plug 104 may be a GU-24, AC 120 style base. In another embodiment, the housing fastener may accommodate an E-26, AC 120 style base or an E-26 adapter base. In the design as shown at FIG. 7, the base plug 104 is connected only a housing plate 170 in conductive contact with one of the two heating sources, the power supply driver circuitry 408.

Diffuser 106 is coupled to the housing 102. In one embodiment diffuser 106 is a snap-on cover that shields the inside components of the LED illumination devices 100 and offers a uniform external appearance. In one embodiment, diffuser 106 is an optic that changes the color or direction of the light emitted from the LED illumination device located between the inside surface of the diffuser 106 and the top surface 171 of the housing 102. As noted diffuser 106 may snap on to the housing 102 at one or more locations (i.e., using corresponding male and female-shaped components), not shown. Alternatively, diffuser 106 may screw on to threads located on the inside of diffuser 106 and matching threads located on the rim of the housing 102. One of ordinary skill in the art will appreciate that diffuser 106 may be coupled to housing other known mechanism such as screws, etc.

In one embodiment, diffuser 106 is toroid-shaped with a centrally located hole that is appropriately sized to receive cap 108. Cap 108 may be coupled to the diffuser using conventional mechanisms such as snap on devices, matching screw threads and/or screws, etc. In one embodiment, cap 108 is made of any material that allows the heated air located between the housing 102 and the diffuser 106 to dissipate through the cap 108 and is therefore a ventilated cap with air holes. In one embodiment, cap 108 is made of perforated plastic to allow heat to dissipate from the heat-generating sources associated with the LED illumination device into the atmosphere. Cap 108 may be emblazoned with the manufacturer's name of the LED illumination device or with any other emblem, logo, or image to indicate the source of the product. If there are slits in the diffuser 106 in lieu of a cap 108 or in the event the open volume between the diffuser 106 and the housing 102 must remain air tight, a conductive means helps diffuse the heat outside of the diffuser, such as the use of a heat conductive metal to increase surface temperature and ultimately convection and or irradiation with the environment.

Figure 2:
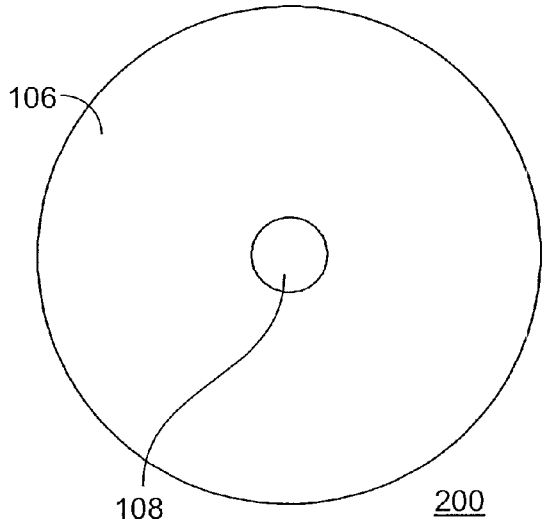
FIG. 2 illustrates a top view of the LED illumination device of FIG. 1.

FIG. 2 illustrates a top view 200 of the LED illumination device 100 of FIG. 1. More specifically, FIG. 2 illustrates diffuser 106 and ventilated cap 108 where the cap 108 is located in the center of the diffuser 106 and is of a rounded shape. FIG. 3 illustrates a bottom view 300 of the LED illumination device 100 of FIG. 1. As discussed above, housing 102 includes a plurality of fins 105 that collectively emanate near the center of the housing base (i.e., near the base plug 104), extend radially across the base of the housing and terminate along the circumferential sides of the housing 102 (see FIG. 1). As shown, the fins 105 are part of the housing 102, but in alternative embodiments, the fins 105 can be of any configuration and geometry including part of a mounted plate to the housing 102.

Figure 4:
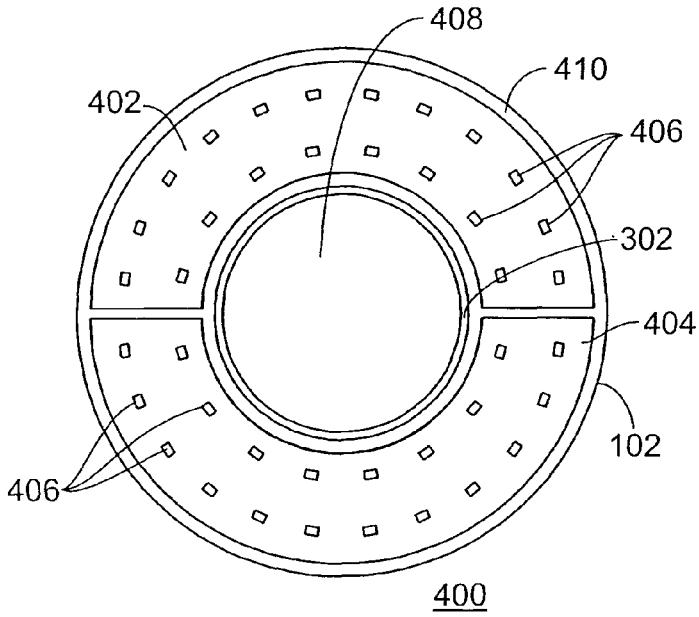
FIG. 4 illustrates a top view of the LED illumination device of FIG. 1 without the diffuser coupled to the housing.

FIG. 4 illustrates a top view 400 of the LED illumination device of FIG. 1 without the diffuser 106 coupled to the housing 102. When diffuser 106 is removed from the housing, the interior components of housing 102 and the LED illumination device 100 are exposed to atmospheric air. Housing 102 includes a housing top flange surface 410 that extends as a lip or flange circumferentially around the body of the housing 102. The center of housing 102 includes a power supply cavity 302 that houses the power supply driver circuitry 408. Power supply driver circuitry 408, as is known in the art, comprises any combination of logic. As used herein "logic" may refer to any single or collection of circuits, integrated circuits, processors, transistors, memory, combination logic circuit, or any combination of the above that is capable of providing a desired operation(s) or function(s). For example, logic may take the form of a processor executing instructions from memory or a dedicated integrated circuit. Power supply driver circuitry 408 conditions the electrical current from, for example, 120 VAC to the appropriate constant current to accommodate the particular LED array associated with the LED illumination device.

FIG. 7 illustrates that the first heating source, namely the driver circuitry 408 can be mounted inside of an volume located between the housing 102 and the diffuser 106. The circuitry 408 is located in an opening 172 created between an inner surface 181 of the support 173 for the toroid-shaped circuit board 402, an inner surface 174 of the diffuser 106 and a top surface 175 of the housing plate 170 part of the housing 102. A first gap 185 is created between the external edge 176 of the driver circuitry 408 and the inner surface 171 where only the wire joints 702 bridge this area. The first gap 185 allows for the heat generated by the driver circuitry 408 not to be exchanged via conduction with the LEDs located on the circuit board 402 thus insulating the first heat source with the LEDs acting as a second heating source.

Heat generated by the driver circuitry 408 can be exchanged by conduction with the housing plate, via convection if there is gas or air within either the first gap 185 or the second gap 177 created between an upper surface 178 of the driver circuitry 408 and the diffuser 106. For example, a cap 108 can be also designed to help bridge the second gap 177 and serve as heat exchanger to evacuate heat from the driver circuitry 408.

Figure 6:
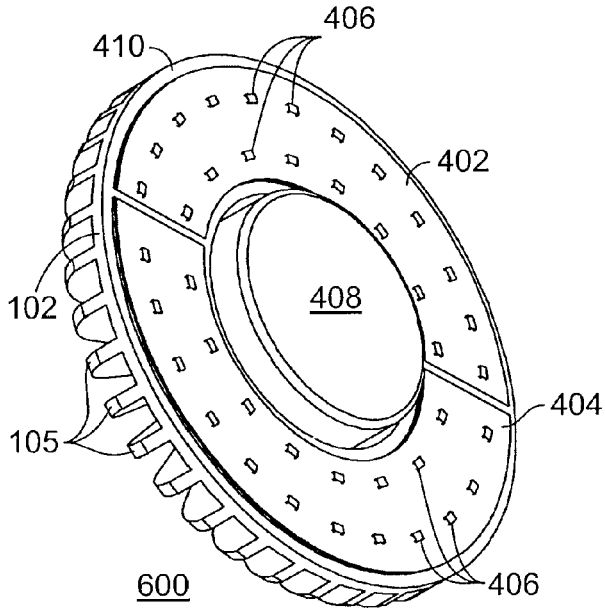
FIG. 6 illustrates a side perspective view of the LED illumination device of FIG. 4.

As shown at FIG. 7, the support 173 for the toroid-shaped circuit board 402 is an area made from conductive metal part of the housing 102 designed to store and transfer calorific energy via conduction from the secondary heating source to the fins 105. In the example as shown at FIG. 6, the heating sources, namely the LEDs and the driver circuitry 408 are distributed as evenly as possible over the volume of the housing to prevent local spikes in heat. The radial and circumferential distribution of the LEDs is also regular and in two or more rows based on the size of the LEDs. Their expected heat generation are radially and circumferentially distributed to create a uniform heat distribution within the entire LED illumination device 100.

In addition, first half toroid-shaped circuit board 402 and second half toroid-shaped circuit boards 404 are coupled to the housing top flange surface 410 using any conventional means. In one embodiment, first and second half toroid-shaped circuit boards 402, 404 are coupled to the housing top flange surface using screws. In another embodiment, the coupling is made using an adhesive or solder. In one embodiment, circuit boards 402, 404 are sized similar to the width of the housing top flange surface 410 and offer some amount of edge relief on both the inner and outer edges of the circuit boards 402, 404 with respect to housing top flange surface 410.

The first and second half toroid-shaped circuit boards 402, 404 include a plurality of LEDs 406. In one embodiment, the plurality of LEDS 406 are coupled to the top of each circuit board 402, 404 in a series circuit configuration. In a preferred embodiment, the first and second half toroid-shaped circuit boards 402, 404 are printed circuit boards. In other embodiments, the boards 402, 404 are breadboards. The plurality of LEDs 406 may be coupled to the circuit boards 402, 404 using surface-mount construction (i.e., soldered on pads or lands on the outer surface of the boards 402, 404) to form a printed circuit assemblies. One of skill in the art, however, will recognize that the plurality of LEDs 406 may be coupled to the circuit boards 402, 404 using other types of construction such as but not limited to through-hole construction.

The first and second half toroid-shaped circuit boards 402, 404 are, in one embodiment, made of 2-sided, 2-ounce per square foot copper board at 0.040 inch in thickness with minimum removal having a base material of FR-4 substrate coated using a white solder mask. In such an embodiment, the copper is maximized to further assist in heat dissipation. One of ordinary skill in the art, however, will appreciate that other types and shapes of boards may also be used in accordance with other embodiments. By constructing the circuit boards 402, 404 in half toroid-shaped segments, the disclosure is able to realize lower material and manufacturing costs as compared to a single toroid-shaped board.

Figure 5:
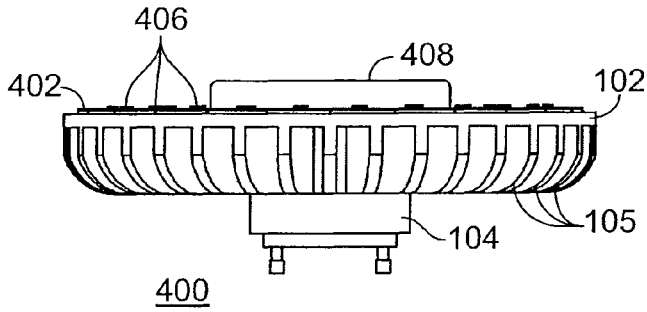
FIG. 5 illustrates a side view of the LED illumination device of FIG. 4.

FIG. 5 illustrates a side view 500 of the LED illumination device of FIG. 4 and illustrates the first half toroid-shaped circuit board 402 sitting atop the housing top flange surface 410 and having plurality of LEDs 406 coupled thereto.

FIG. 6 illustrates a side perspective view 600 of the LED illumination device of FIG. 4 and further shows the power supply driver circuit 408 on the same plane as the first and second half toroid-shaped circuit boards 402, 404. In one embodiment, the top of the power supply driver circuit 408 is elevated relative to circuits 402, 404 such that the heat generated from the power supply driver circuit 408 emanates outward in the direction of the most heat resistant portion of the light emitter as part of the plurality of LEDs 406 without adversely affecting the micro-electronics and different other heat sensitive portions of the plurality of LEDs 406 themselves.

FIG. 7 illustrates a cross-sectional view 700 of the LED illumination device of FIG. 1. FIG. 7 illustrates the components generally discussed above with respect to FIGS. 1-6 and further illustrates wire joint(s) 702 that couples the power supply driving circuit 408 to the first half toroid-shaped circuit board 402. One or more other wire joints (not shown) may be used to couple the power supply driving circuitry 408 to the second half toroid-shaped circuit board 404. Wire joint (s) may include any number of suitable grade wire or other conduits for the transfer of electrical current from the power supply driving circuit 408 to the circuit boards 402, 404 and their associated plurality of LEDs 406.

The distance between top surface 175 of the housing plate 170 and the top flange surface 410 upon which the first and second half toroid-shaped circuit boards 402, 404 are placed is smaller than the distance between the top surface 175 of the housing plate and the upper surface 178 of the driver circuitry 408. In that case, a portion of the radial surface of the driver circuitry 408 is allowed to irradiate heat directly on the heat resistant portion of the LEDs on the housing 102 and not irradiate the heat to the heat sensitive portion of the LEDs. Further, a larger portion of the heat of the driver circuitry 408 can be made to irradiate directly to the diffuser 106 by increasing the visible surfaces between these two elements.

Figure 8:
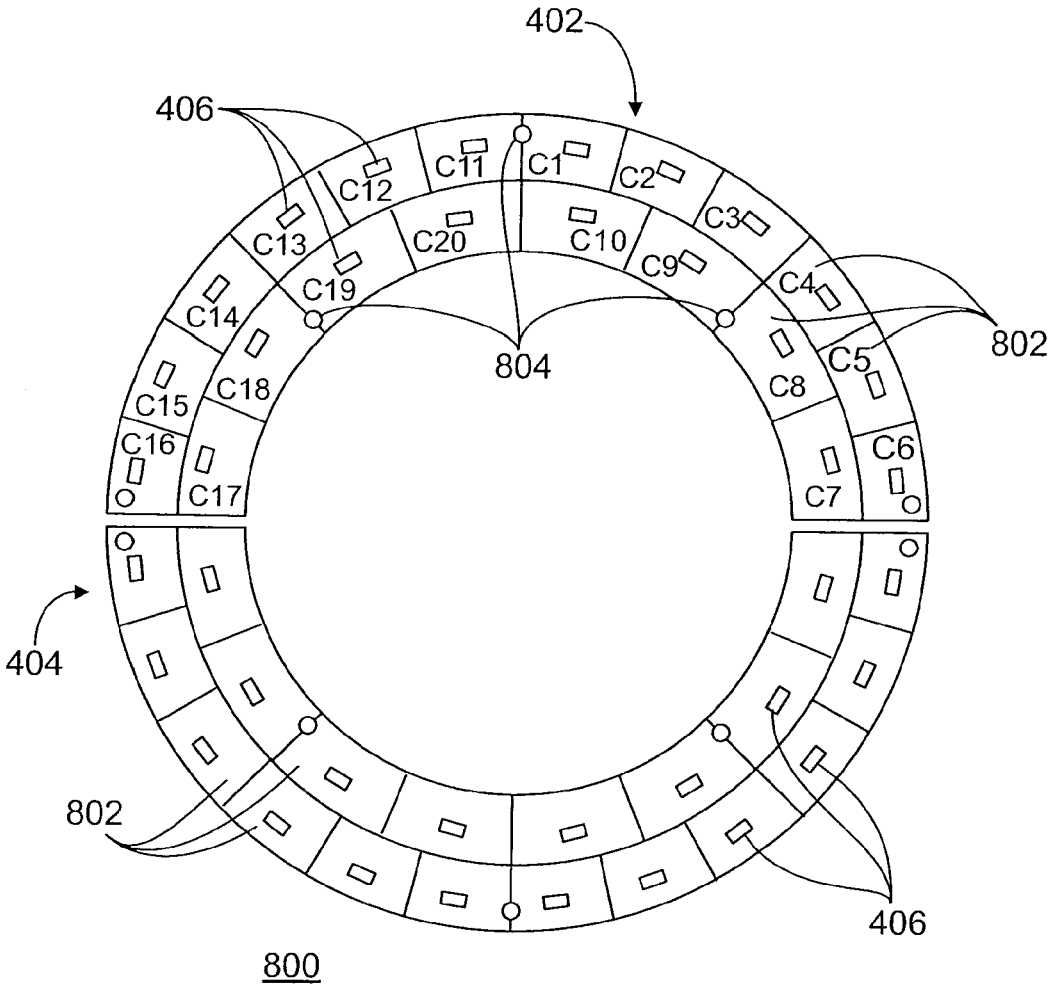
FIG. 8 illustrates a top view of the half toroid-shaped circuit boards of the LED illumination device of FIG. 1.

FIG. 8 illustrates a top view 800 of the half toroid-shaped circuit boards 402, 404 of the LED illumination device of FIG. 1. As shown, first and second half toroid-shaped circuit boards 402, 404 may include through-holes 804 for coupling the circuit 402, 404 to the housing top flange surface 410. For example, a screw may be used to pass through the through-holes and couple the circuit boards 402, 404 to the housing top flange surface 410. First and second half toroid-shaped circuit boards 402, 404 further include a plurality of planes 802, each with equal surface areas. The boundaries of each plane 802 represent the separation of copper within the boards 402, 404 and are made by any conventional process such as etching during fabrication of the boards 402, 404, with each trace line representing a separation of copper pad associated with that portion of the circuit board 402, 404. The back side (not shown) of the circuit boards 402, 404 may be a mirror image of the front side.

In one embodiment the electrical current from the power supply driver circuit 408 is coupled to the first and second half toroid-shaped circuit boards 402, 404 such that the current first travels to the LEDs 406 located to the left and right of the center through holes 804 (i.e., the through holes located at the upper most location and lower most location relative to the height of the figure) and then travels in series along each of the LEDs 406 located along the outer ring of LEDs 406 on each board 402, 404 toward the left and right sides of the boards 402, 404, respectively, and then travels back along the inner ring of LEDs 406 and meet at a mutual common point with the power supply driver circuit 408. By way of reference to the first half toroid-shaped circuit board 402, the wire joint(s) 702 (not shown) carries current from the power supply driver circuit 408 to LED C1 and LED C11. LED C1 is coupled in series with LEDs C2-C10, and LED C11 is coupled in series with LEDs C16-C20.

Figure 9:
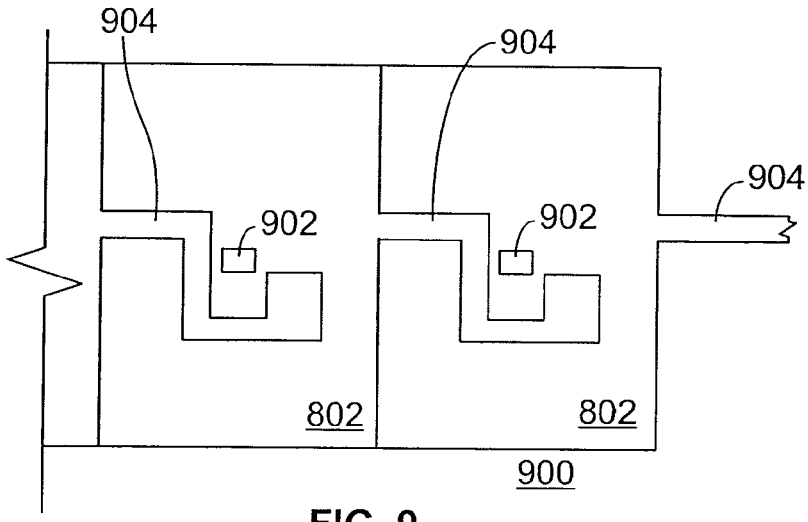
FIG. 9 illustrates an exemplary layout of the plurality of circuit components associated with the first and second half toroid-shaped circuit boards of the LED illumination device of FIG. 1.

FIG. 9 illustrates an exemplary layout of the plurality of planes 802 associated with the first and second half toroid-shaped circuit boards 402, 404. In particular, FIG. 9 illustrates two identical planes 802 where the lines drawn depict separation of the underlying copper of the boards 402, 404. Each plane 802 includes a heat sink 902 and a plane extension 904. LEDs are mounted on heat sink 902 and the anodes and cathodes of each LED 406 are coupled to the appropriate plane 802 or plane extension 904, as the case may be, to connect the circuit. Thus, the planes 802, together with the plane extensions 904, collectively permit the flow of current through the LEDs 406.

Figure 11:
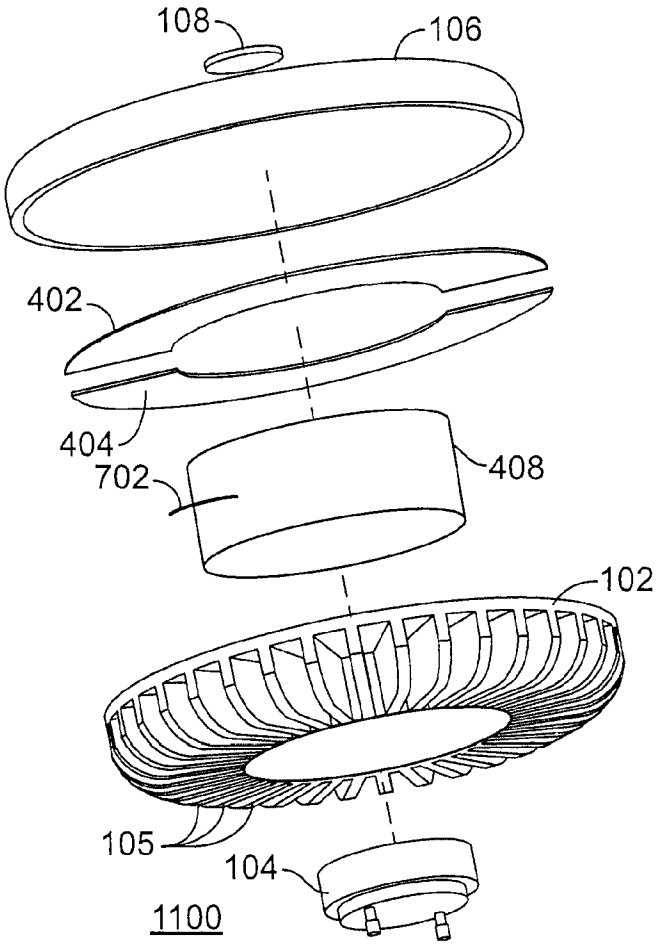
FIG. 11 illustrates a bottom exploded view of the LED illumination device of FIG. 1.
Figure 10:
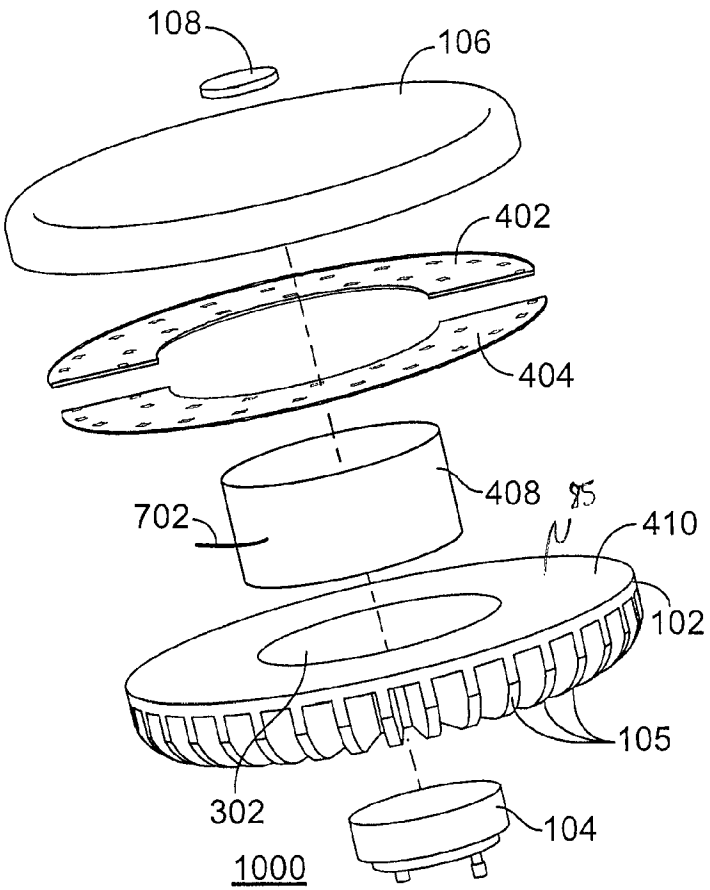
FIG. 10 illustrates an top exploded view of the LED illumination device of FIG. 1.

FIG. 10 illustrates a top exploded view 1000 of the LED illumination device of FIG. 1 and FIG. 11 illustrates a bottom exploded view 1100 of the LED illumination device of FIG. 1, collectively illustrating each of the individual components described in reference to FIGS. 1-9.

Figure 12:
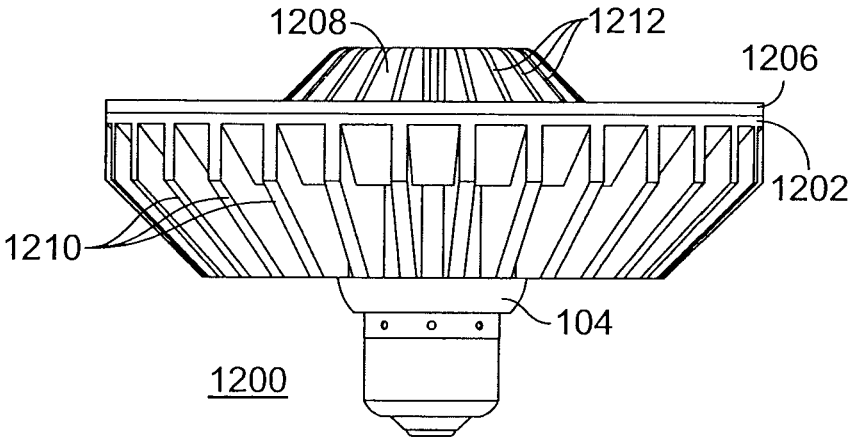
FIG. 12 illustrates a side view of an LED illumination device in accordance with a second embodiment of the disclosure.

FIG. 12 illustrates a side view 1200 of an LED illumination device in accordance with a second embodiment of the disclosure. The LED illumination device of FIG. 12 includes a housing 1202, a diffuser 1206, a heat sink cap 1208, a plurality of housing fins 1210, a plurality of cap fins 1212 and a base plug 104. Housing 1202 is identical to housing 102 of FIG. 1 in construction but of a different shape. As described below, housing 1202 includes a housing trough for the plurality of LEDs 406. Housing 1202 includes a plurality of housing fins 1112 that are also identical to the plurality of fins 105 of FIG. 1 but adapted to fit the sides of housing 1202. The plurality of housing fins 1112 serve as heat sinks for the heat generated by the LED illumination device of FIG. 12. As before, base plug 104 may take the form of an GU-24, E-26 or E-26 adapter style base. Affixed to the top of the housing 1202 is diffuser 1206, which is also identical to diffuser 106 of FIG. 1 but of a different shape (as described below with reference to FIG. 13). Thus, diffuser 1206 may be configured as a snap-on element for coupling to the top of the housing 1202. Finally, LED illumination device of FIG. 12 includes a heat sink cap 1206 having a plurality of cap fins 1212. Heat sink cap 1206 and its fins 1212 may be constructed in the same manner as housing 1202 and the plurality of housing fins 1212 and serve as a second heat sink for the LED illumination device of FIG. 12. Heat sink cap 1208 may be coupled to housing 1202 using any conventional manner including for example snap on components and matching screw threads.

Figure 13:
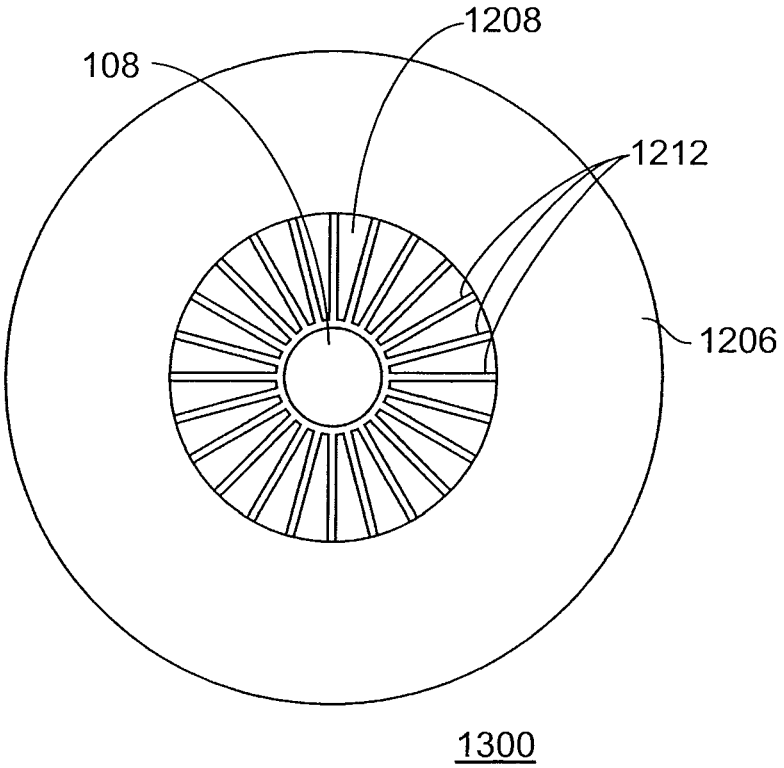
FIG. 13 illustrates a top view of the LED illumination device of FIG. 12.

FIG. 13 illustrates a top view 1300 of the LED illumination device of FIG. 12 illustrating heat sink cap 1208, the plurality of cap fins 1212, the diffuser 1206 and the optional cap 108. As before, in one embodiment, cap 108 is ventilated to allow it to better transfer heat from the heat sink cap 1208 to the atmosphere.

Figure 14:
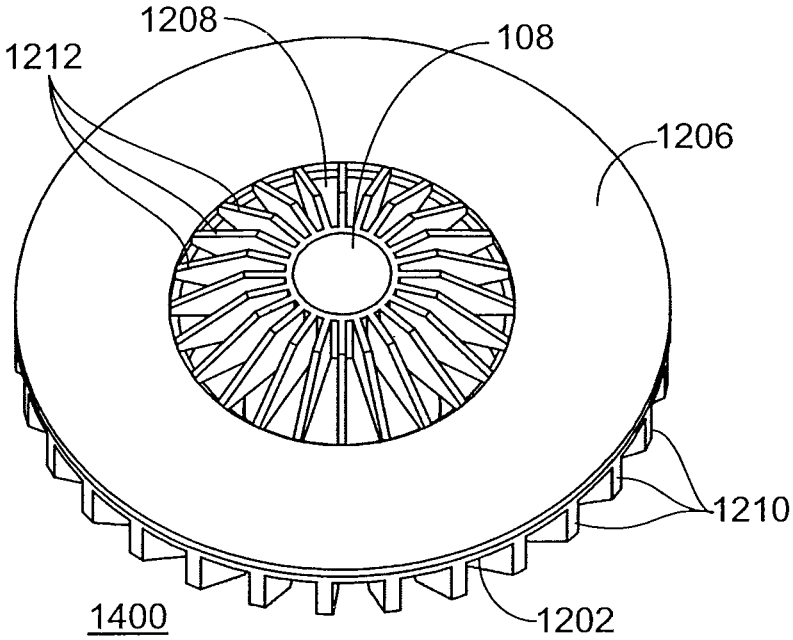
FIG. 14 illustrates a top perspective view of the LED illumination device of FIG. 12.
Figure 15:
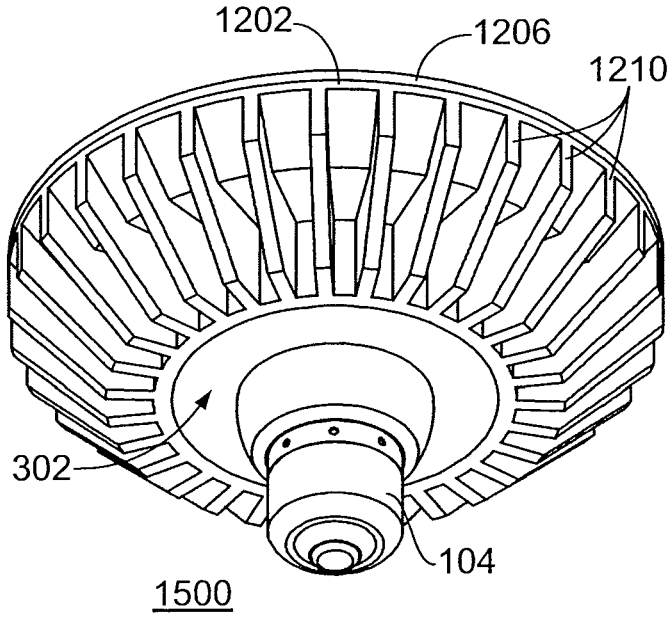
FIG. 15 illustrates a bottom perspective view of the LED illumination device of FIG. 12.

FIG. 14 illustrates a top perspective view 1400 of the LED illumination device of FIG. 12 and FIG. 15 illustrates a bottom perspective view 1500 of the LED illumination device of FIG. 12. Power supply cavity 302 is illustrated in FIG. 15 as occupying the area inside housing 1202 generally above the base plug 104 in a similar location as identified in reference to the LED illumination device of FIGS. 1-11.

Figure 16:
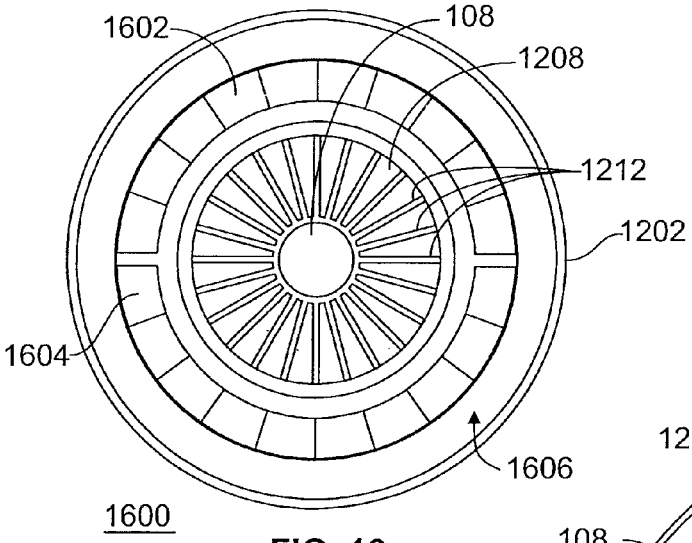
FIG. 16 illustrates a top view of a partially-assembled LED illumination device of FIG. 12 illustrating the relative placement of the heat sink cap and the half toroid-shaped circuit boards in the trough of the housing.
Figure 17:
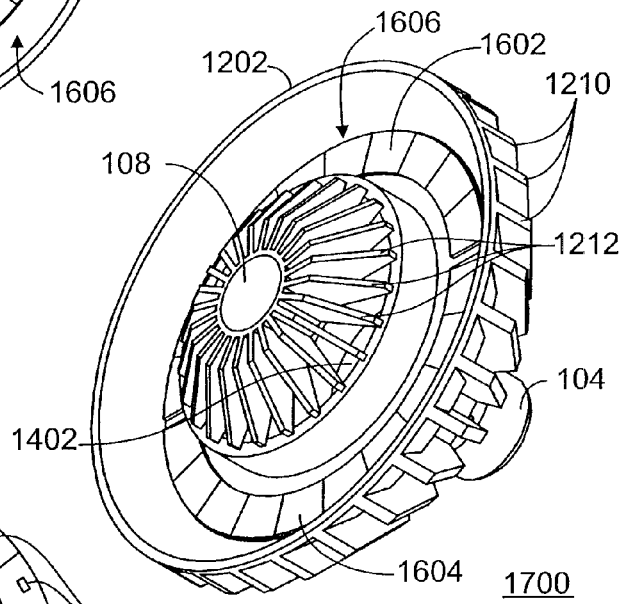
FIG. 17 illustrates a side perspective view of the LED illumination device of FIG. 16.

FIG. 16 illustrates a top view 1600 of a partially-assembled LED illumination device of FIG. 12 without the diffuser 1206 coupled to the housing 1202 and without any reflector elements (discussed below in FIG. 19). FIG. 17 illustrates a side perspective view 1700 of the LED illumination device of FIG. 16. Collectively, FIGS. 16 and 17 illustrate the first and second half toroid-shaped circuit boards 1602 and 1604 associated with the LED illumination device. Circuit boards 1602 and 1604 are similar to circuit boards 402 and 404 but only have one row of constituent panels 802 and LEDs 406 (described in reference to FIG. 18) whereas circuit boards 402 and 404 have two rows of panels 802 and LEDs 406. Further, as illustrated in FIG. 17, circuit boards 1602 and 1604 sit in a housing trough or a recessed platform 1606 within housing 1208. Circuit boards 1602, 1604 may be coupled to housing 1202 in the same manner as boards 402, 404 are coupled to housing 102.

Figure 18:
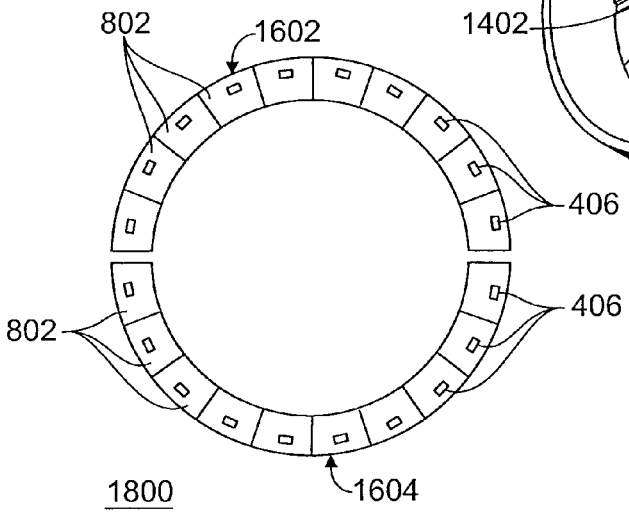
FIG. 18 illustrates a top view of the half toroid-shaped circuit boards of the LED illumination device of FIG. 12.

FIG. 18 illustrates a top view 1800 of the first and second half toroid-shaped circuit boards 1602, 1604 of the LED illumination device of FIG. 12. Like circuit boards 402 and 404, circuit boards 1602 and 1604 comprise a plurality panels 802 and a plurality of LEDs 406.

Figure 19:
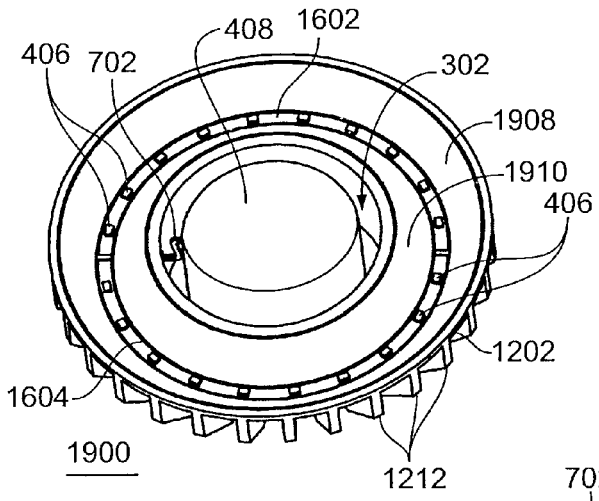
FIG. 19 illustrates a top perspective view of a partially-assembled LED illumination device of FIG. 12 illustrating the relative placement of the half toroid-shaped circuit boards in the trough of the housing, the inner and outer reflectors and the power supply driver circuitry in the power supply cavity.

FIG. 19 illustrates a top perspective view of another partially-assembled LED illumination device of FIG. 12 without the diffuser 1206 coupled to the housing 1202 and without the heat sink cap 1208. Outer reflector 1908 and inner reflector 1910, which may be shaped at 45 degree angles (or any other degree angles) and may be manufactured out of chrome and or plastic, are designed to direct the light emitted from the plurality of LEDs 1802 outwards instead of providing full flood light as the LED illumination device of FIGS. 1-11 generally provides. Reflectors 1908, 1910 may be held in place or coupled to the housing 1202 and/or the first and second half toroid-shaped circuit boards 1602, 1604 using a variety of conventional means such as but not limited to adhesives, snap-on components, etc.

Figure 20:
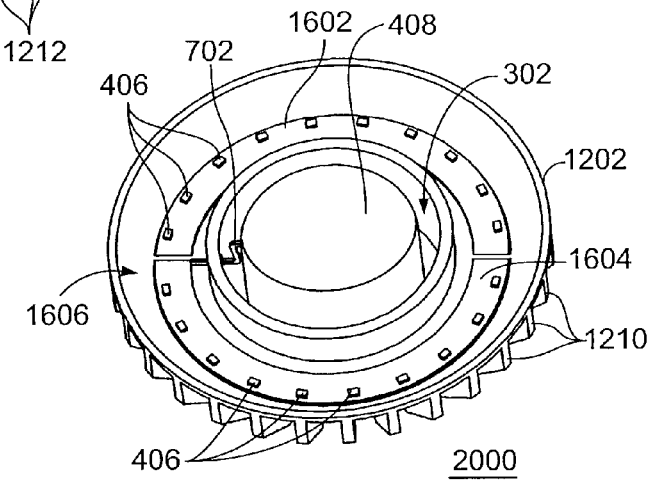
FIG. 20 illustrates a top perspective view of the LED illumination device of FIG. 19 without the inner and outer reflectors.

FIG. 19 further illustrates power supply cavity 302, power supply driving circuit 408 and wire joint(s) 702. FIG. 20 illustrates a top perspective view 1900 of the LED illumination device of FIG. 19 without the outer and inner reflectors 1908, 1908.

Figure 21:
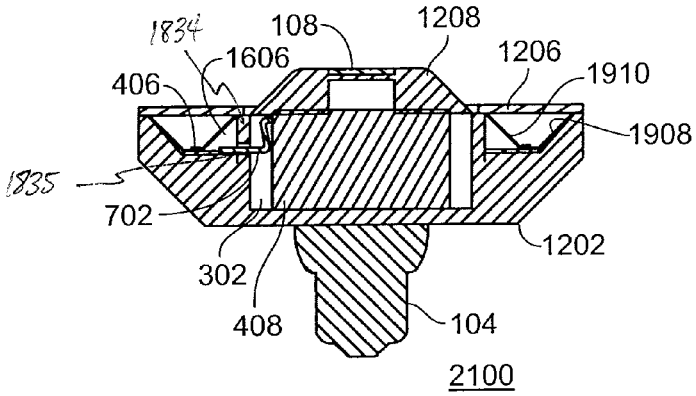
FIG. 21 illustrates a cross-sectional view of the LED illumination device of FIG. 12.

FIG. 21 illustrates a cross-sectional view 2100 of the LED illumination device of FIG. 12 showing the components discussed above with respect to FIGS. 12-20 and FIG. 22 illustrates an exploded view 2200 of the LED illumination device of FIG. 12 showing the same components. The embodiment as shown at FIGS. 14-22 and as best illustrated in FIG. 21 shows how in some configurations the second gap 177 as shown at FIG. 7 may be replaced by a heat sink cap 1208 having a plurality of heat sink fins 1212 for the diffusion of the heat generated by the driver circuitry 408 directly via conduction through the sink cap 1208 into ambient air via convection. In this embodiment, the second gap 175 has been kept. Several other tools to help better evacuate heat in addition to the housing fins 1210 can also be used like the outer reflector 1908 and the inner reflector 1910.

In this second embodiment, an internal ring 1834 may be used and includes a recessed platform 1606 designed for stability, to close the LED area or to protect the LEDs from irradiation from the driver circuitry 408. The internal ring 1834 as shown includes holes 1835 for the passage of wire joints 702.

As discussed above and illustrated in the accompanying drawings, the power supply driver circuitry 408 is placed on the same plane or in front of the LEDs 406. Among other advantages, the above description of the LED illumination devices include an isolated power supply driver circuitry 408 relative to the half toroid-shaped circuit boards 402, 404 and 1602, 1604 that allows for a unique lighting form factor with a ring of light while simultaneously optimizing cooling of the power supply driver circuitry 408. By using the half toroid-shaped circuit boards 402, 404 and 1602, 1604, the disclosure optimizes the use of circuit board material and results in lower material and manufacturing costs.

The foregoing benefits are substantial as compared to conventional PAR lamps. Such conventional PAR lamps are generally cone shaped with LEDs on the base of the cone facing outward with powers supply driver circuitry buried internally within the cone/housing. In such prior art, the temperate of the powers supply driver circuitry is not efficiently dissipated (e.g., to any heat sink devices on the body of the cone) without causing damage to the LEDs.

Not only does the foregoing disclosure overcome the disadvantage of positing the power supply driver circuitry directly behind the LEDs by the relative placement of the powers supply driver circuitry 408 vis-à-vis the LEDs 408 thereby permitted exposure of heat generated by the powers supply driver circuitry 408 to the atmosphere, but the embodiments discussed herein are low profile like a fluorescent Circline lamp. It is envisioned that the embodiments described in FIGS. 1-11 and variants thereof may be adopted to replace traditional Circline lamps and the embodiments described in FIGS. 12-22 may be adopted to replace traditional PAR lamps.

Figure 22:
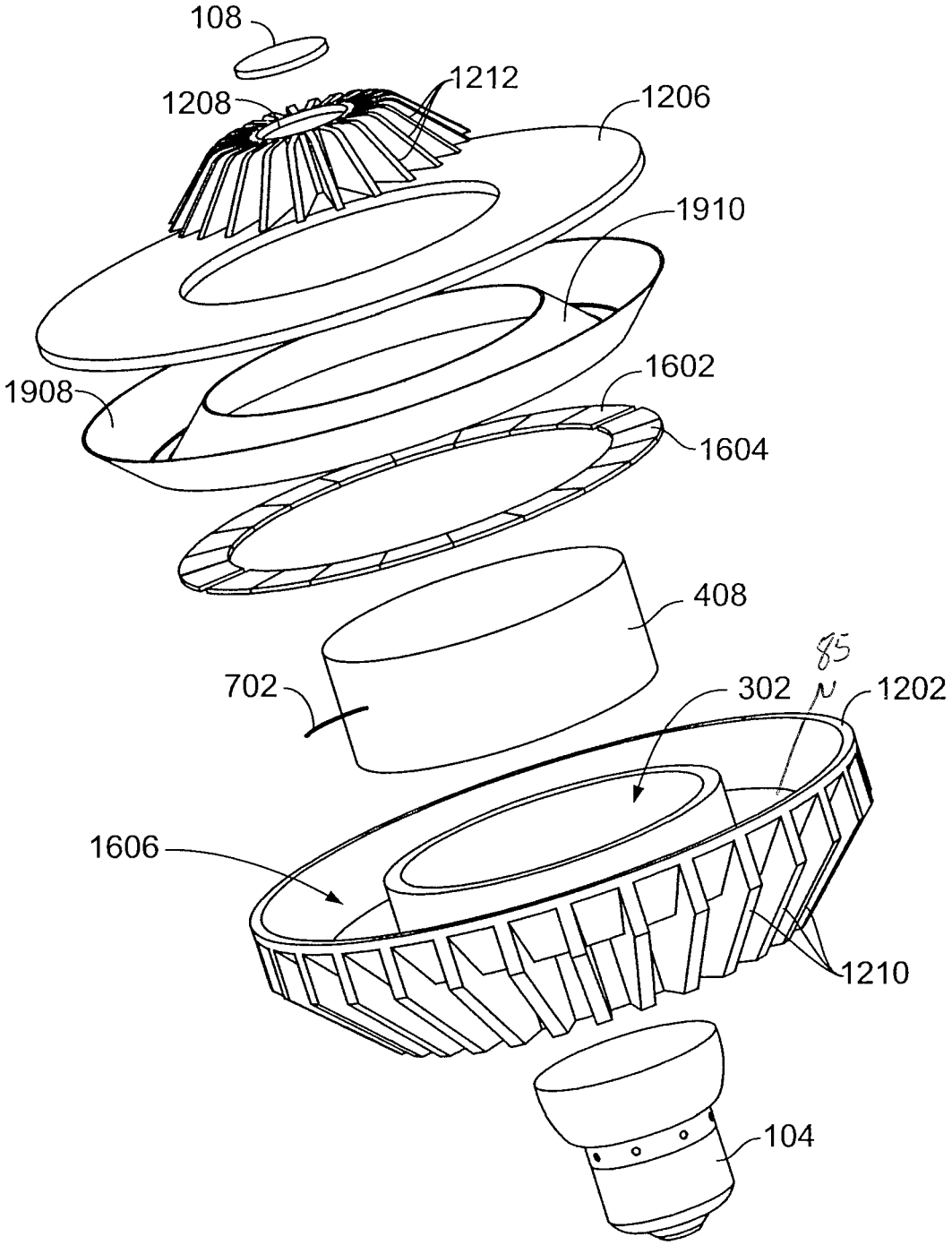
FIG. 22 illustrates an exploded view of the LED illumination device of FIG. 12.

FIGS. 10 and 22 show two different light emitting diode illumination devices 1000 and 2200 (also described as 100 in other figures) made of a housing 102 or 1202 respectively with an external peripheral ring 85 as shown at FIGS. 7 and 21 for the support of at least a circuit board 402 or 1602. These figures also show an inner surface 171, and a power supply cavity 302 defined in the external peripheral ring 85 by the inner surface 171 and at its base by a housing plate 170 having a top surface 175 in the power supply cavity 302 and a bottom surface 182, a base plug 104 coupled to the bottom surface 182 of the housing plate. The base plug 104 is capable of receiving power from a conventional power source and transferring the power through the plug 104.

The devices 1000 and 2200 respectively also include a power supply driver circuitry 408 coupled to the base plug 104 and connected to the top surface 175 of the housing plate 170 as shown in FIGS. 7 and 21. The power supply driver circuitry 408 also includes an external edge 176 at a distance from the inner surface 174 of the housing and results in the creation of a gap 185. Further, the devices 1000 and 2200 include at least a circuit board 402 or 1602 supported by the external peripheral ring 85 for a plurality of LEDs. As shown at FIGS. 7 and 21, to transfer the power from the plug 104 transformed by the circuitry 408 to the LEDs, a series of conductive wire joints 702 are used between the circuit board 402 or 1602. As shown, the wire joints 702 bridge over the gap 185.

As shown the board 402 or 1602 house a plurality of LEDs 406 connected to the circuit board and a diffuser coupled to the housing to shield the plurality of LEDs 406 from the atmosphere. In yet another embodiment, light emitting diode illumination devices 1000 and 2200 include a housing 102 or 1202 with an external peripheral ring 85 as shown at FIGS. 7 and 21 for the support of at least a circuit board 402 and 1602 and an inner surface 171, and a power supply cavity 302 defined in the external peripheral ring 85 by the inner surface 171 and at its base by a housing plate 170 having a top surface 175 in the power supply cavity 302 and a bottom surface 182.

Further, the devices 1000 and 2200 include a base plug 104 coupled to the bottom surface 182 of the housing plate 170, the base plug 104 capable of receiving power from a conventional power source and transferring the power through the plug 104 to the driver circuitry 408. The power supply driver circuitry 408 is also coupled to the base plug 104 and connected to the top surface 175 of the housing plate 170. The power supply driver circuitry 408 having an external edge 176 at a distance from the inner surface 171 of the housing creating a gap 185. Finally, the devices 1000 or 2200 include at least a circuit board 402 or 1602 supported by the external peripheral ring 85 for a plurality of LEDs 406 and where an upper surface 178 of the power supply driver circuitry 408 is located above the circuit board 402 and 1602.

Other advantages will be recognized by one having ordinary skill in the art. It will also be recognized that the above description describes mere examples and that other embodiments are envisioned and covered by the appended claims. For example, it would be possible to place the power supply driver circuitry 408 on the outside of the housings described above and to place the plurality of LEDs 408 on the inside or toward the center of the housings. It would further be possible to mount the power supply driver circuitry 408 and the plurality of LEDs 408 on the same printed circuit board in either of the arrangements discussed above with minor adaptations while still falling within the scope of the present disclosure. It is therefore contemplated that the present invention cover any and all modifications, variations or equivalents that fall within the spirit and scope of the basic underlying principles disclosed above and claimed herein.

What is claimed is:

1. A light emitting diode (LED) illumination device comprising:

a housing with an external peripheral ring for the support of at least a circuit board and an inner surface, and a power supply cavity defined in the external peripheral ring by the inner surface and at its base by a housing plate having a top surface in the power supply cavity and a bottom surface;

a base plug coupled to the bottom surface of the housing plate, the base plug capable of receiving power from a conventional power source and transferring the power through the plug;

a power supply driver circuitry coupled to the base plug and connected to the top surface of the housing plate, the power supply driver circuitry having an external edge at a distance from the inner surface of the housing creating a gap;

at least a circuit board supported by the external peripheral ring for a plurality of LEDs, wherein the circuit board is connected via wire joints over the gap to the power supply driver circuitry.

2. The device of claim 1, further comprising a plurality of LEDs connected to the circuit board and a diffuser coupled to the housing to shield the plurality of LEDs from the atmosphere.

3. The device of claim 2, wherein the diffuser includes a cap for the passage of air.

4. The device of claim 3, wherein the cap includes a heat sink cap with heat sink fins, and is connected to an upper surface of the driver circuitry.

5. The device of claim 4, wherein the housing further includes a recessed platform with an internal ring with holes for the passage of the wire joints.

6. The device of claim 2, further including an outer reflector adjacent to the plurality of LEDs.

7. The device of claim 6, further including an inner reflector adjacent also adjacent to the plurality of LEDs.

8. The device of claim 1, wherein the housing includes heat transfer fins.

9. The device of claim 1, wherein the at least a circuit board includes two half toroid-shaped circuit boards and each comprises a plurality of LEDs arranged in a ring.

10. A light emitting diode (LED) illumination device comprising:

a housing with an external peripheral ring for the support of at least a circuit board and an inner surface, and a power supply cavity defined in the external peripheral ring by the inner surface and at its base by a housing plate having a top surface in the power supply cavity and a bottom surface;

a base plug coupled to the bottom surface of the housing plate, the base plug capable of receiving power from a conventional power source and transferring the power through the plug;

a power supply driver circuitry coupled to the base plug and connected to the top surface of the housing plate, the power supply driver circuitry having an external edge at a distance from the inner surface of the housing creating a gap; and at least a circuit board supported by the external peripheral ring for a plurality of LEDs, wherein an upper surface of the power supply driver circuitry is located above the circuit board.

11. The device of claim 10, further comprising a plurality of LEDs connected to the circuit board, and further comprising a diffuser coupled to the housing to shield the plurality of LEDs from the atmosphere, and wherein the plurality of LEDs receive irradiative heat from at least a portion of the external edge.

12. The device of claim 11, wherein the diffuser includes a cap for the passage of air.

13. The device of claim 12, wherein the cap is a heat sink cap with heat sink fins, and is connected to the upper surface of the driver circuitry.

14. The device of claim 13, wherein the housing further includes a recessed platform with an internal ring.

15. The device of claim 11, further including an outer reflector adjacent to the plurality of LEDs.

16. The device of claim 15, further including an inner reflector adjacent also adjacent to the plurality of LEDs.

17. The device of claim 10, wherein the housing includes heat transfer fins.

18. The device of claim 10, wherein the at least a circuit board includes two half toroid-shaped circuit boards and each comprises a plurality of LEDs arranged in a ring.

* * * * *